US006991196B2

(12) United States Patent
Wheeler

(10) Patent No.: US 6,991,196 B2
(45) Date of Patent: Jan. 31, 2006

(54) STORAGE DEVICE

(76) Inventor: David L. Wheeler, 5 Berkshire La., Spotsylvania, VA (US) 22553

( * ) Notice: Subject to any disclaimer, the term of this patent is extended or adjusted under 35 U.S.C. 154(b) by 5 days.

(21) Appl. No.: 10/738,037

(22) Filed: Dec. 18, 2003

(65) Prior Publication Data

US 2005/0139720 A1 Jun. 30, 2005

(51) Int. Cl.
*B65H 49/22* (2006.01)

(52) U.S. Cl. ..... 242/597.7; 242/129

(58) Field of Classification Search ..... 242/597.7, 242/129, 130.2

See application file for complete search history.

(56) References Cited

U.S. PATENT DOCUMENTS 2,630,980 A * 3/1953 Weaver ..... 242/129
3,017,136 A * 1/1962 Noffke ..... 242/129
3,729,092 A 4/1973 Marcell
3,974,980 A 8/1976 Marcell
4,032,102 A 6/1977 Wolf et al.
4,856,729 A * 8/1989 Maraman ..... 242/129

* cited by examiner

*Primary Examiner*—John M. Jillions
(74) *Attorney, Agent, or Firm*—Richard C. Litman

(57) ABSTRACT

The storage device is provided in the form of a reel for dispensing electrical wire. The reel includes a small disk at one end rotatably mounted to an eyebolt for suspension by hook from an overhead structure and a large thick circular disk at a second end. Slots are provided through the small disk adjacent the perimeter edge. The large thick disk is provided with a plurality of recessed pockets symmetrically arranged around the center of the top face of the large disk. A divider divides each pocket into a plurality of storage compartments. Each pocket includes a compartment cover closing the storage compartments. A plurality of flexible straps is provided. One end of each strap is secured to the large disk. A second end of each strap is rotatably received around the shaft of the eyebolt after passage through corresponding slots in the small disk.

20 Claims, 8 Drawing Sheets

STORAGE DEVICE

BACKGROUND OF THE INVENTION

1. Field of the Invention

The present invention relates to storage devices and more particularly to a storage device for storing and dispensing electrical wire.

2. Description of the Related Art

A well-known problem encountered by electricians and other electrical workers when dispensing electrical wire from a coil, such as ROMEX™ wire, is kinks, nicks, tears, knots, twists, etc. In U.S. Pat. No. 3,729,092 issued Apr. 24, 1973 to Marcell and U.S. Pat. No. 3,974,980 issued Aug. 17, 1976 to Marcell, this problem is resolved by using a wire reel having a base plate for supporting a coil of wire. A plurality of flexible lines are secured to the plate at points symmetrical arranged around the center of the plate that converge and are secured together and connected to a clip that may be hung on a hook for suspension from a rafter or pipe. The coils of wire to be dispensed by the Marcell reels rest upon the base plates. A plurality of handles is formed in the base plate for carrying the Marcell reels. Neither of the Marcell patents teaches storing small electrical supplies, such as twist-on wire fasteners, connectors, etc., commonly used by electricians and other electrical worker.

U.S. Pat. No. 4,032,102 issued Jun. 28, 1977 to Wolf et al. teaches a tray suspension means for hanging potted plants and such that provides for coupling modular configurations of trays with one tray suspended below another. The upper tray is provided with means for interlocking with couplers at one end of suspension members. The suspension members have a second end terminating in a hanger having a hook for rotatably suspending the tray. Additional suspension members are provided for further suspending additional trays. The suspension members are made of cloth, elastic material, plastic or even metal.

None of the above inventions and patents, taken either singly or in combination, is seen to describe the instant invention as claimed. Thus a storage device solving the aforementioned problems is desired.

SUMMARY OF THE INVENTION

The storage device of the present invention is provided in the form of a reel for dispensing electrical wire. The reel includes a small disk at one end rotatably mounted to an eyebolt for suspension by hook from an overhead structure such as a rafter, pipe or the like. The small disk includes equidistantly spaced slots forming passages through the disk around the perimeter of the disk.

A second end of the reel is provided in the form of a thick circular disk having a plurality of recessed pockets symmetrically arranged around the center of the top face of the disk. Each pocket is provided with a divider dividing each pocket into a plurality of storage compartments and a lid covering the storage compartments. A plurality of equally spaced slots is provided adjacent the perimeter edge of the large disk.

One end of a flexible strap is secured within each slot of the large disk. A second end of the straps is provided with eyelets that are received around the shaft of the eyebolt after passage through the slots in the small disk. When the small disk with straps attached is passed through the center of a coil of electrical wire and the eyebolt connected for suspension from a ceiling structure, the coil of wire is supported upon the flexible straps of the reel above the top face. This unique arrangement allows for storing and dispensing wire from the reel and also the storing and dispensing of electrical supplies as desired.

Accordingly, it is a principal object of the invention to provide a storage device in the form of a reel that allows for the storing and dispensing of electrical wire from the reel and also the storing and dispensing of electrical supplies as needed.

It is another object of the invention to provide a reel for convenient use by electricians and other electrical workers.

It is a further object of the invention to provide a storage device that enables users to be more productive and provide a better quality of work.

Still another object of the invention is to provide a storage device that lessens the chance of forming kinks, nicks, tears, knots and twists in the wire thus reducing wasted wire, time and electrical problems.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
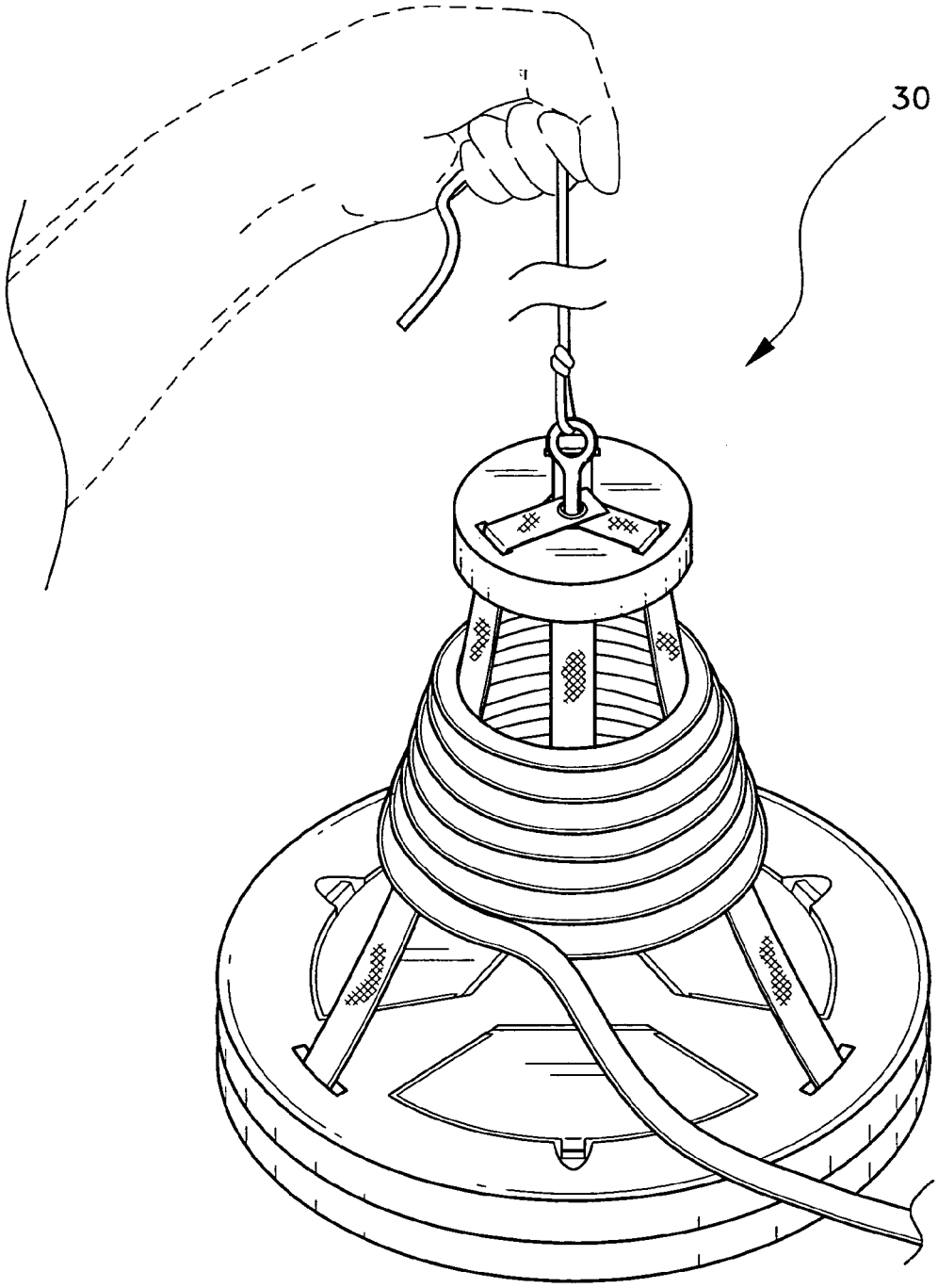
FIG. 1 is an environmental, perspective view of a storage device according to the present invention.
Figure 2:
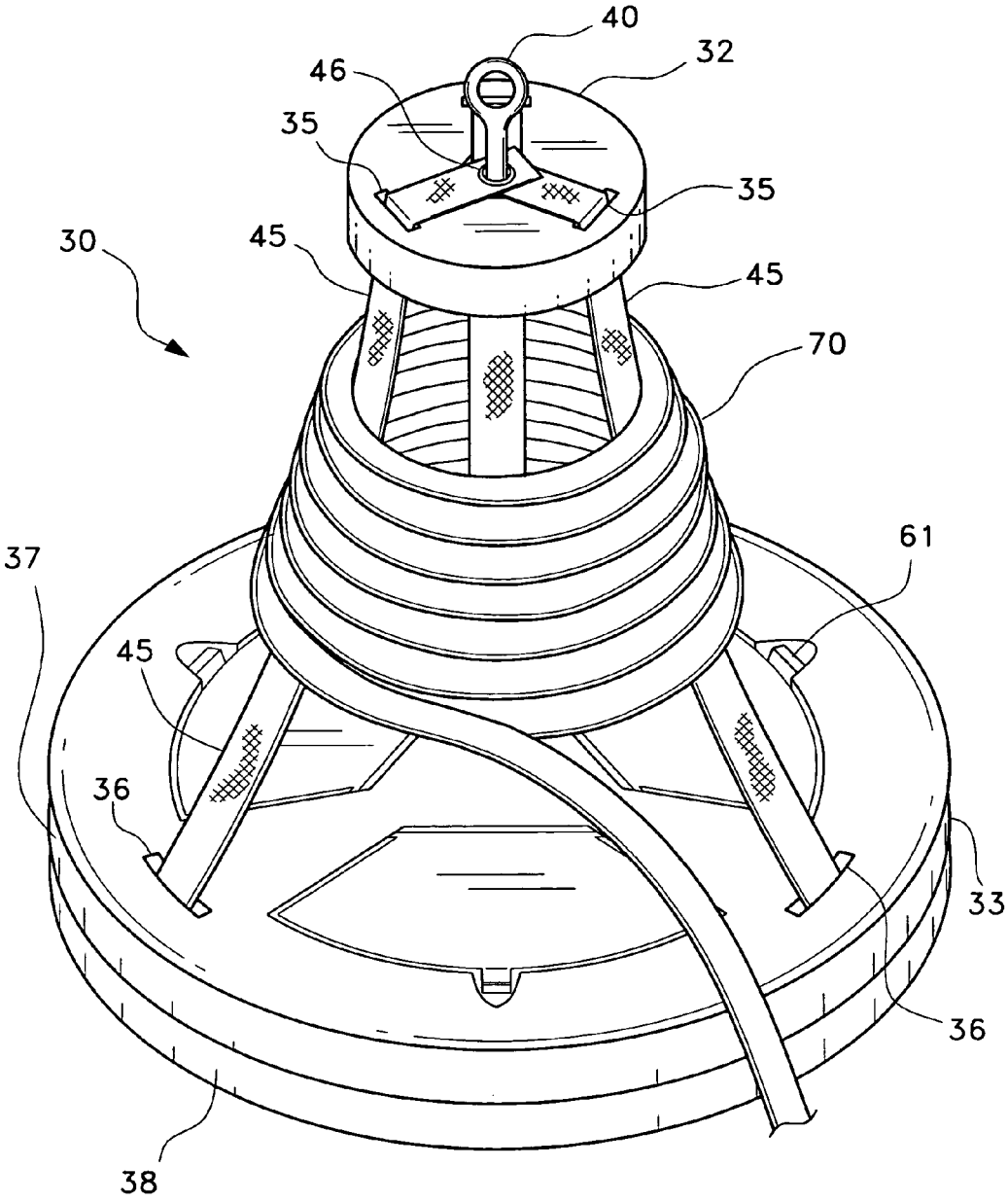
FIG. 2 is a perspective view of the storage device with a coil of electrical wire rotatably supported thereon.
Figure 3:
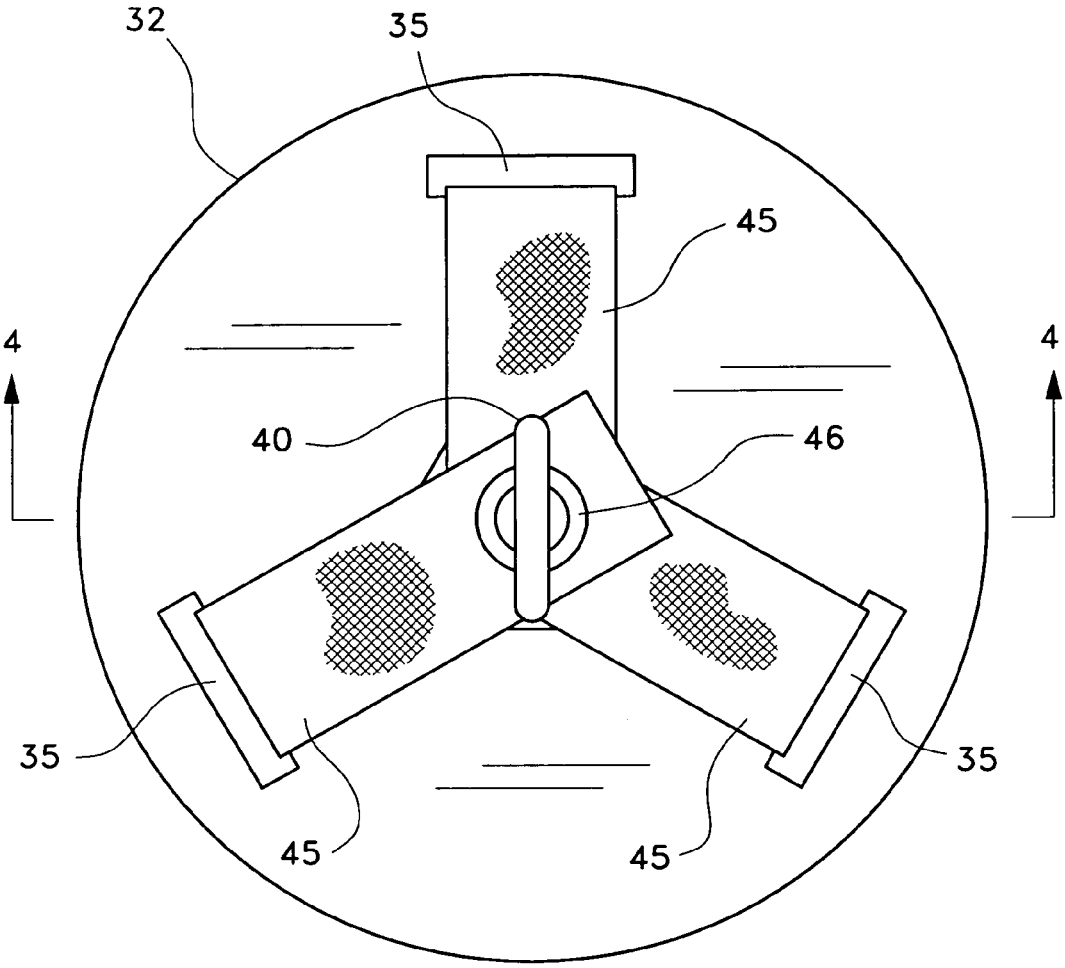
FIG. 3 is a top view of the small disk assembly.
Figure 4:
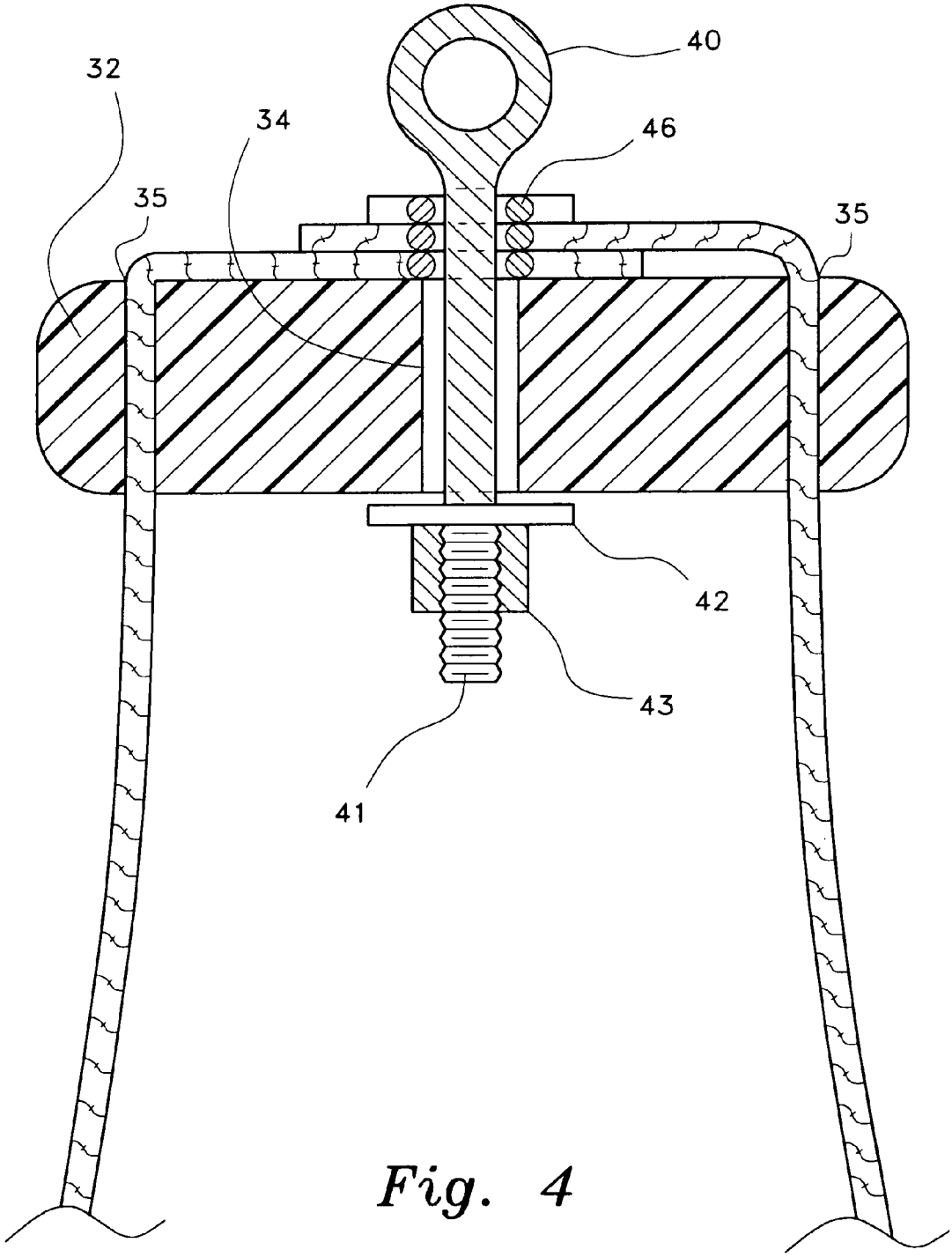
FIG. 4 is a cross-sectional view of the small disk assembly taken along line 4—4 of FIG. 3.

The present invention is provided in the form of a reel 30 for dispensing a coil 70 of electrical wire as shown in FIGS. 1 and 2. One end of the reel 30 includes a small disk 32 a large disk 33 and a plurality of flexible straps 45 connecting the small disk 32 to the large disk 33. Small disk 32 and large disk 33 may be formed from any suitable material. Preferably the disks are formed from wood, plywood or a durable hard plastic material. Flexible straps 45 are preferably formed from a durable canvas or nylon material.

As best seen in FIGS. 2–5, small disk 32 includes a central aperture 34 sized to rotatably receive the shaft 41 of eyebolt 40. Disk 32 is rotatably mounted to the eyebolt 40 upon a washer 42 held on the shaft 41 of eyebolt 40 by a nut 43 for suspension by hook from an overhead structure such as a rafter, pipe or the like. The small disk 32 includes a plurality of slots 35 equally spaced along the perimeter of the disk 32 and passing through the disk 32.

A second end of reel 30 is provided in the form of a large disk 33. In the preferred form, disk 33 is formed of plywood, plastic or other suitable materials and includes a top layer 37 and a bottom layer 38. A plurality of equally spaced slots 36 is provided through the top layer 37 of the large disk 33 adjacent the perimeter edge.

A plurality of recessed pockets 51 are symmetrically arranged around the center of the top face 50 of disk 33. Each pocket 51 is provided with a plastic divider 52 dividing each pocket 51 into a plurality of storage compartments 55–57. The divider has a base in the shape of pocket 51 and includes an arcuate wall 53 and a straight wall 54 connected to the center of the arcuate wall 53 to form interior compartments 55–57 within each pocket 51. A hinge means is provided for pivotally connecting a compartment cover 60 to the inner wall of each pocket 51.

Figure 6:
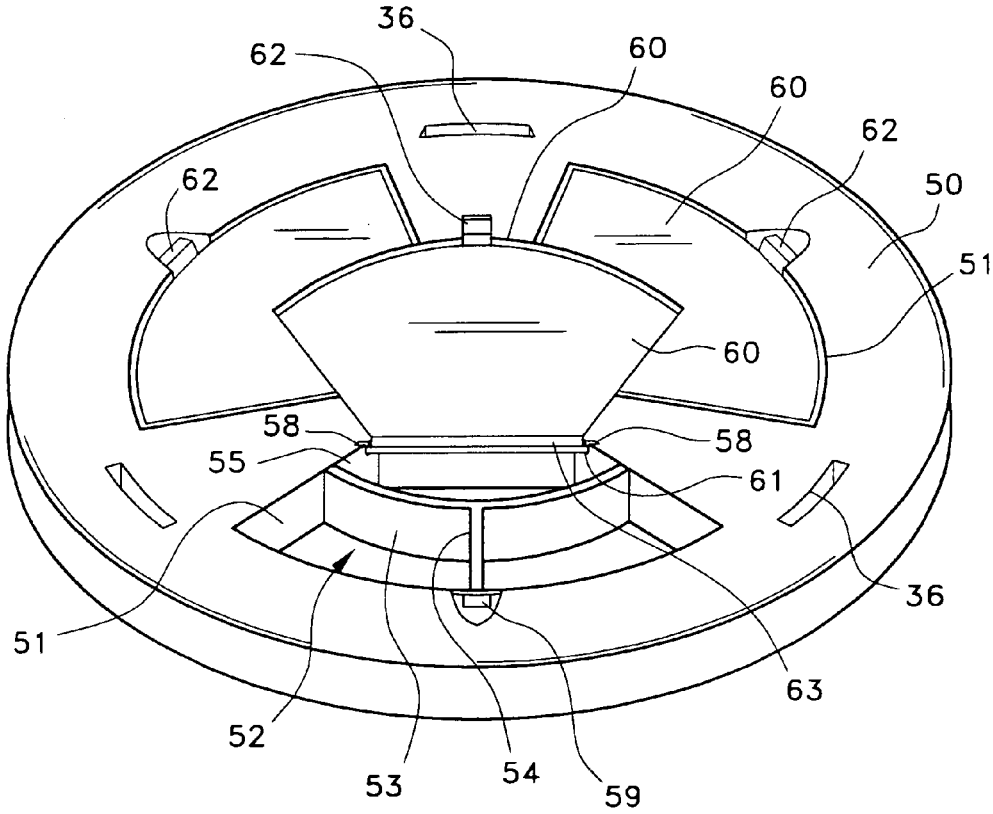
FIG. 6 is a perspective of the tray of the storage device according to the present invention.
Figure 7:
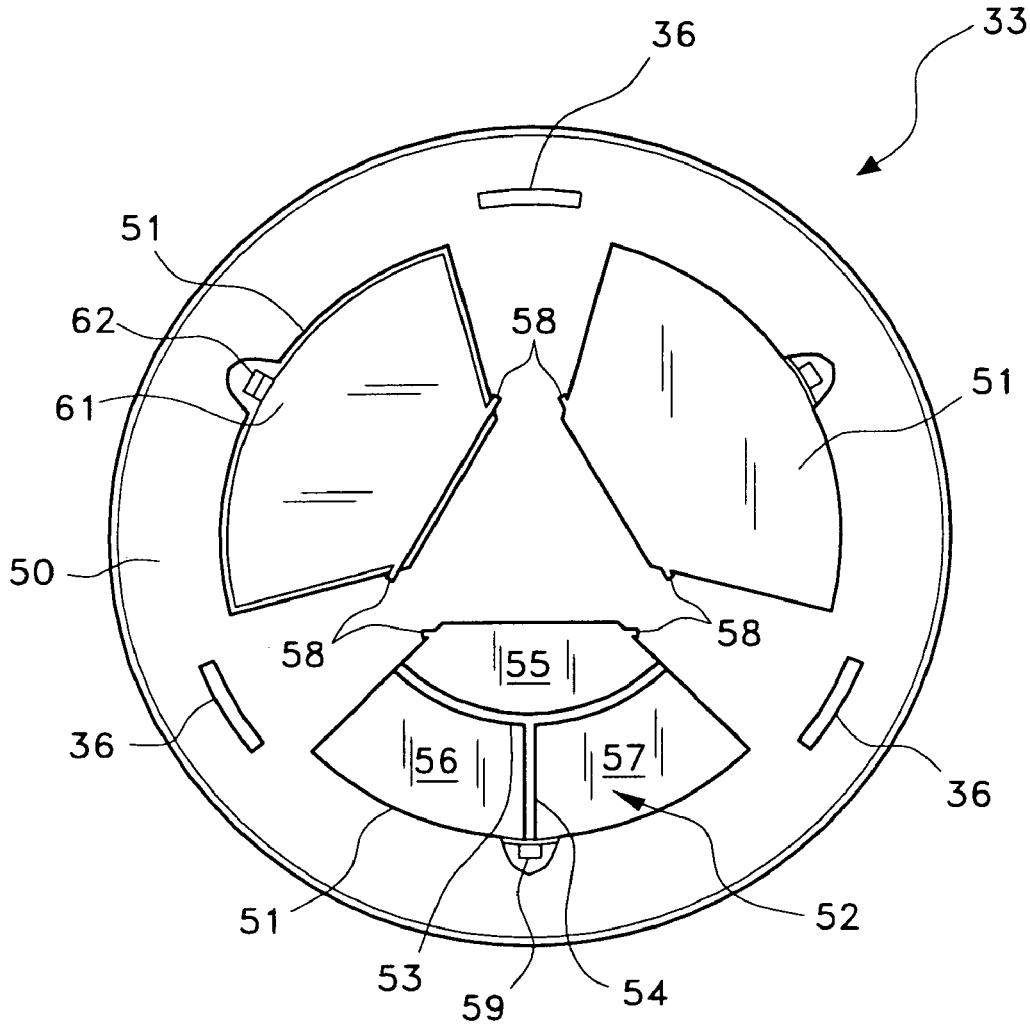
FIG. 7 is a top view of the tray according to the present invention.
Figure 8:
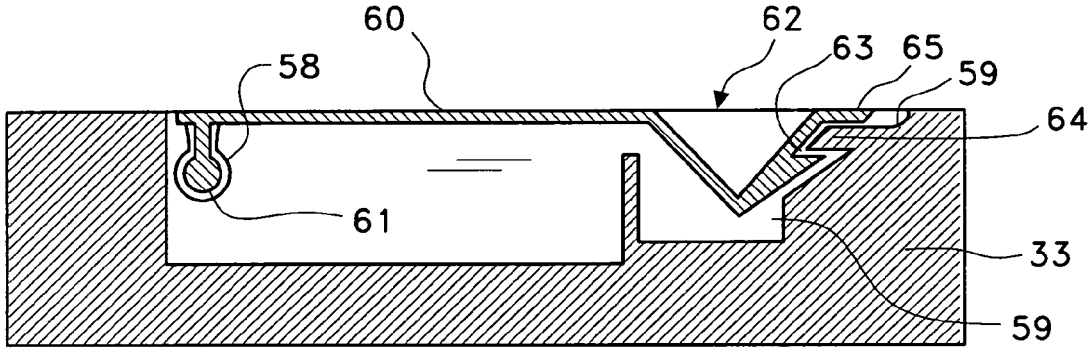
FIG. 8 is a cross-sectional view of one of the tray of the storage device.

Referring to FIGS. 6–8 where it is shown that in a preferred form, the hinge means are provided in the form of a pair of pivot pin receiving recesses 58 in top face 50 adjacent the sidewalls of each pocket 51, and a pair of pivot pins 61 extending from opposite side edges at a pivot end of each plastic compartment cover 60. Recesses 58 are constructed so that pins 61 are pivotally received in recesses 58 with a snap fit. Each cover 60 is provided with a cover latch 62 extending from a front edge of the cover 60. Cover latch 62 is V-shaped in cross-section and is provided with a locking groove 63 and a finger tab portion 65.

Referring now to FIG. 8, a stepped recess 59 is provided in top face 50 of disk 33 for receiving the cover latch 62. A locking tongue 64 protrudes outwardly from a first step of stepped recess 59 for engagement with locking groove 63 to securely lock cover 60 to disk 33 so as to be flush with top face 50. When cover 60 is in the locked position, finger tab 65 lies upon the first step of stepped recess 59 in position to be easily manipulated by a finger to release latch 62 from recess 59 and pull cover 60 to an open position.

Figure 5:
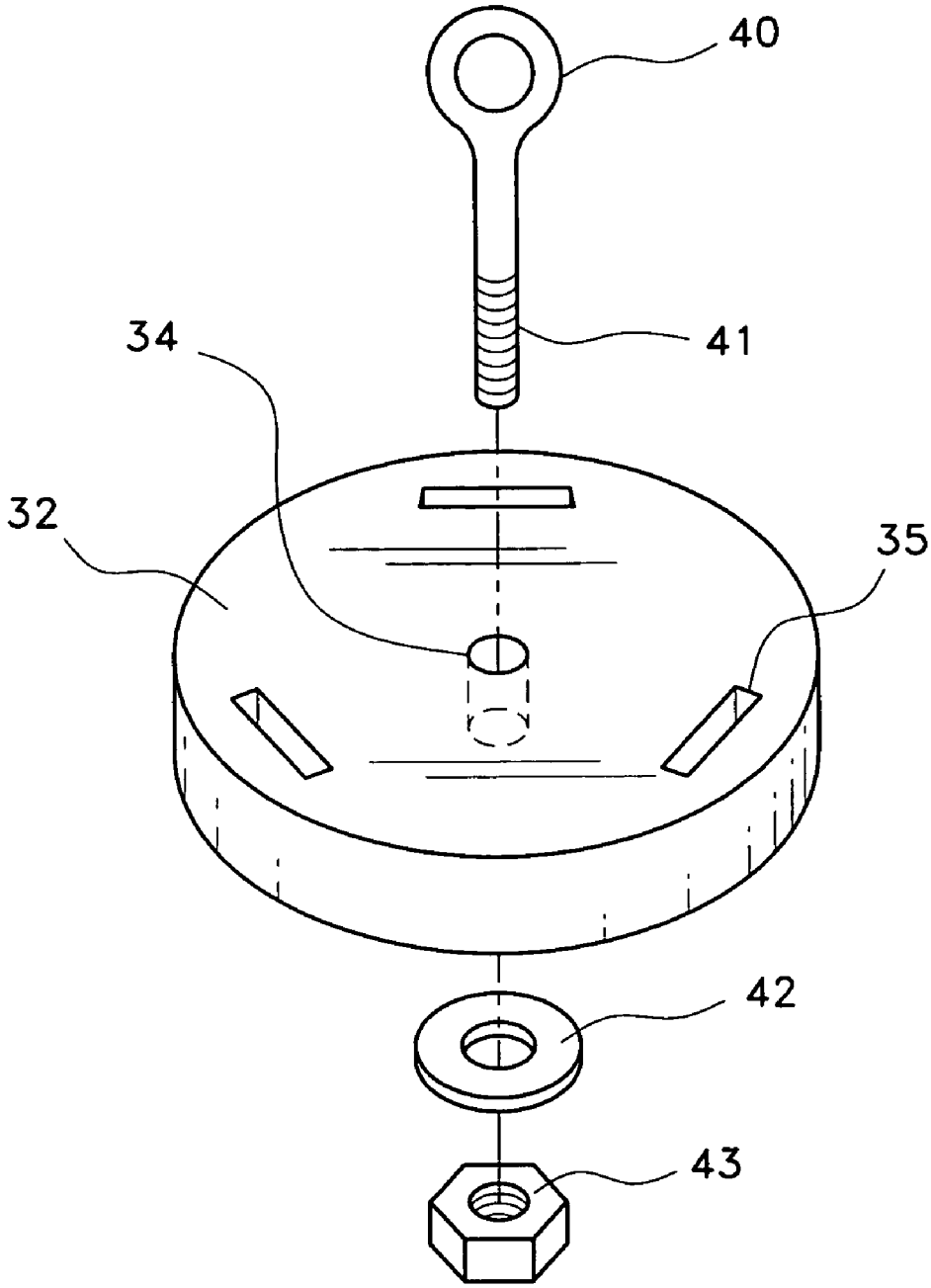
FIG. 5 is an exploded view of the small disk assembly.

Referring now to FIGS. 2 and 7, a plurality of equally spaced slots 36 is provided adjacent the perimeter edge of the upper layer 37 of large disk 33. One end of each flexible strap 45 is passed through a corresponding slot 36 of layer 37 and is tacked and adhesively secured between layers 37 and 38 of disk 33. The second ends of the straps 45 are provided with eyelets 46 and are passed through corresponding slots 35 in small disk 32. The eyelets 46 are rotatably received around the shaft 41 of eyebolt 40 as best shown in FIG. 5. The ends of flexible straps 45 may also be tacked or adhesively secured within slots 35 and 36.

To use the reel 30, the small disk 32 with straps 45 attached to the eyebolt 40 is passed through the center of a coil 70 of electrical wire. The eyebolt 40 is connected to a hook or other means for suspension from a ceiling structure. The coil of wire 70 is supported upon the flexible straps 45 of the reel 30 above the top face 50 of large disk 33. This unique arrangement allows for storing and dispensing electrical wire from the reel 30 and also the storing and dispensing of electrical supplies from the compartments 55–57 in large disk 33 as desired.

It is to be understood that the present invention is not limited to the embodiment described above, but encompasses any and all embodiments within the scope of the following claims.

I claim:

1. A storage device, comprising:

a reel for dispensing electrical wire, wherein said reel includes a small disk rotatably mounted upon an eyebolt for suspension by hook from an overhead structure, a large thick circular disk provided with a plurality of recessed pockets symmetrically arranged around a center of a top face of said large disk, and a plurality of elongated flexible straps, wherein said straps are symmetrically arranged and connected at a first end to said large disk adjacent the periphery thereof and symmetrically arranged and connected at a second end to said small disk adjacent the periphery thereof.

2. The storage device according to claim 1, wherein said large disk and said small disk are wooden.

3. The storage device according to claim 1, wherein said large disk and said small disk are plastic.

4. The storage device according to claim 1, wherein said straps are tacked and/or adhesively attached to said large disk and said small disk.

5. The storage device according to claim 1, further comprising:

compartment covers pivotally mounted to said large disk for closing said recessed pockets.

6. The storage device according to claim 1, wherein said small disk further includes a central aperture and said eyebolt passes through said central aperture, said small disk being rotatably mounted on said eyebolt by a washer and nut attached to a shaft of said eyebolt.

7. The storage device according to claim 1, wherein each said disk includes symmetrically arranged slots adjacent a peripheral edge thereof and first and second ends of said straps are tacked and/or adhesively secured within said slots.

8. The storage device according to claim 1, wherein said small disk includes symmetrically arranged slots adjacent a peripheral edge thereof, said straps include first and second ends, said second end of said straps including eyelets, and said second end of said straps passes through said slots and said eyelets are rotatably received on a shaft of said eyebolt.

9. The storage device according to claim 2, wherein said large disk includes a top and a bottom layer adhesively secured together.

10. The storage device according to claim 9, wherein said top layer of said large disk includes symmetrically arranged slots adjacent the periphery thereof.

11. The storage device according to claim 10, wherein a first end of each said strap passes through a corresponding slot is tacked and/or adhesively secured between said layers.

12. The storage device according to claim 3, wherein said straps are adhesively attached to said large and small disks.

13. The storage device according to claim 12, wherein said large and small disks include symmetrically arranged slots adjacent the periphery thereof and said straps are adhesively secured within said slots.

14. The storage device according to claim 5, wherein said cover includes a latch with a finger tab for opening and closing said cover.

15. The storage device according to claim 5, wherein each said cover includes a pair of pivot pins protruding from a side edge thereof and a V-shaped cover latch formed with a locking groove, the top face of said large disk includes a pair of pivot pin receiving recesses and a stepped recess formed adjacent each recessed pocket, said pivot pin receiving recesses being shaped to pivotally receive said pivot pins with a snap-fit, and each said stepped recess having a locking tongue protruding from a first step thereof for engagement with said locking groove to secure said cover to said large disk.

16. The storage device according to claim 1, further including a pocket plate having a curved wall and a straight wall for dividing each pocket into a plurality of compartments.

17. A storage device, comprising:

a reel for dispensing electrical wire, wherein said reel includes a small wooden disk rotatably mounted upon an eyebolt for suspension by hook from an overhead structure, said small disk includes a central aperture and said eyebolt passes through said central aperture, said small disk being rotatably mounted on said eyebolt by a washer and nut attached to a shaft of said eyebolt;

a large thick wooden disk provided with a plurality of recessed pockets symmetrically arranged around a center of a top face of said large disk, said large disk includes a top and a bottom layer adhesively secured together, said top layer of said large disk includes symmetrically arranged slots adjacent the periphery thereof; and a plurality of symmetrically arranged elongated flexible straps, each strap having a first end passing through a corresponding slot in said top layer of said large disk and tacked and/or adhesively secured between said layers, said straps being symmetrically arranged and connected at a second end to said small disk adjacent the periphery thereof.

18. The storage device according to claim 17, wherein said small disk further includes symmetrically arranged slots adjacent a peripheral edge thereof, said second end of said straps including eyelets, said second end of said straps passes through corresponding said slots of said small disk and said eyelets are rotatably received on said shaft of said eyebolt.

19. The storage device according to claim 18, further including:

compartment covers pivotally mounted to said large disk for closing said recessed pockets, wherein each said cover includes a pair of pivot pins protruding from a side edge thereof and a V-shaped cover latch formed with a locking groove; and the top face of said large disk includes a pair of pivot pin receiving recesses and a stepped recess formed adjacent each recessed pocket, said pivot pin receiving recesses being shaped to pivotally receive said pivot pins with a snap-fit, and each said stepped recess having a locking tongue protruding from a first step thereof for engagement with said locking groove to secure said cover to said large disk.

20. The storage device according to claim 19, further including a pocket plate having a curved wall and a straight wall for dividing each pocket into a plurality of compartments.

* * * * *